US010779688B1

(12) United States Patent
Herring

(10) Patent No.: US 10,779,688 B1
(45) Date of Patent: Sep. 22, 2020

(54) ONE PIECE TILEABLE SHOWER UNIT

(71) Applicant: Avery S. Herring, Petal, MS (US)

(72) Inventor: Avery S. Herring, Petal, MS (US)

( * ) Notice: Subject to any disclaimer, the term of this patent is extended or adjusted under 35 U.S.C. 154(b) by 0 days.

(21) Appl. No.: 16/215,231

(22) Filed: Dec. 10, 2018

(51) Int. Cl.
*A47K 3/28* (2006.01)

(52) U.S. Cl.
CPC ..... *A47K 3/283* (2013.01)

(58) Field of Classification Search
CPC ..... A47K 3/283; A47K 3/284; A47K 3/04; A47K 3/16; A47K 3/28
USPC ..... 4/614
See application file for complete search history.

(56) References Cited

U.S. PATENT DOCUMENTS

| | | | | | |
|---|---|---|---|---|---|
| 1,639,705 | A * | 8/1927 | Schmiedeknecht | A47K 3/283 | 4/614 |
| 3,139,627 | A * | 7/1964 | Rice | A47K 3/28 | 52/35 |
| 3,149,187 | A * | 9/1964 | Wood | A47K 3/28 | 264/259 |
| 3,827,086 | A * | 8/1974 | Seymour | A47K 3/04 | 52/35 |
| 3,992,825 | A * | 11/1976 | May | A47K 3/28 | 52/35 |
| 4,557,004 | A * | 12/1985 | Piana | A47K 3/40 | 4/596 |
| 5,371,980 | A * | 12/1994 | Dix | A47K 3/40 | 4/613 |
| 5,542,218 | A | 8/1996 | Rompel | | |
| 5,845,347 | A * | 12/1998 | Young | A47K 3/008 | 4/613 |
| 5,913,777 | A * | 6/1999 | Gerber | A47K 3/40 | 52/35 |
| 7,490,371 | B2 * | 2/2009 | Torres | A47K 3/40 | 4/612 |
| 7,562,495 | B1 * | 7/2009 | Fairchild | A47K 3/40 | 4/613 |
| 7,950,078 | B2 * | 5/2011 | Houpt | E04F 13/0862 | 4/574.1 |
| 8,375,480 | B2 | 2/2013 | Cook | | |
| 8,857,109 | B1 | 10/2014 | Kirby | | |
| 9,332,883 | B1 * | 5/2016 | Angelella | A47K 3/008 | |
| 9,687,118 | B2 * | 6/2017 | Schindler | A47K 3/40 | |
| 2004/0154232 | A1 * | 8/2004 | Kenny | A47K 3/281 | 52/35 |
| 2008/0222891 | A1 * | 9/2008 | Cook | A47K 3/40 | 29/890.141 |
| 2010/0170035 | A1 * | 7/2010 | Kik, Sr. | A47K 3/405 | 4/613 |
| 2013/0264240 | A1 * | 10/2013 | Wallis | B65D 85/00 | 206/459.5 |

FOREIGN PATENT DOCUMENTS

| | | |
|---|---|---|
| AU | 2013202049 | 3/2013 |
| DE | 19883809068 | 3/1988 |

* cited by examiner

*Primary Examiner* — Benjamin R Shaw
(74) *Attorney, Agent, or Firm* — George L Williamson

(57) ABSTRACT

Method and apparatus for a one-piece tileable shower unit having pre-assembled full length walls and having a floor with a curb surrounding a central drain wherein the inner surface of the shower stall is coated with a thinset for having individual tile unit pieces attached thereto wherein the shower stall unit is made of one-piece. A first embodiment includes a foam base and a second embodiment includes fiberglass to which the individual tile units are attached.

6 Claims, 4 Drawing Sheets

ONE PIECE TILEABLE SHOWER UNIT

BACKGROUND OF THE INVENTION

Field of the Invention

The present invention relates generally to bathroom fixtures and, more particularly, is concerned with a one-piece tileable shower unit.

Description of the Related Art

Devices relevant to the present invention have been described in the related art, however, none of the related art devices disclose the unique features of the present invention.

In U.S. Pat. No. 5,913,777 dated Jun. 22, 1999, Gerber disclosed a prefabricated shower module and method of shower construction. In U.S. Pat. No. 4,557,004 dated Dec. 10, 1985, Piana disclosed a waterproof shower module with tile ready inner surfaces. In U.S. Pat. No. 8,375,480 dated Feb. 19, 2013, Cook disclosed a method for manufacturing a prefabricated shower module. In U.S. Pat. No. 7,950,078 dated May 31, 2011, Houpt disclosed a preformed structural support for tile. In U.S. Pat. No. 8,857,109 dated Oct. 14, 2014, Kirby disclosed a tile ready corner seat. In U.S. Pat. No. 5,542,218 dated Aug. 6, 1996, Rompel disclosed a structural support frame for ceramic tile corner seats and service trays. In Australian Patent Application No. AU 2013202049 dated Mar. 27, 2013, Daiyan disclosed a tileable shower base and its method of preparation. In German Patent Application No. DE 19883809068 dated Mar. 18, 1988, Claus disclosed a shower basin and method of mounting it on a solid base.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a one-piece tileable shower unit having pre-assembled full length walls being approximately 60" to 96" tall and having a floor with a curb and a central drain wherein the inner surface of the shower stall is coated with a thinset having individual tile unit pieces attached thereto wherein the shower stall unit is made of one-piece. Two embodiments of the one-piece tileable shower stall of the present invention are provided wherein one includes a coated foam core base and the second embodiment includes fiberglass to which the individual tile units are attached.

An object of the present invention is to provide a tileable shower unit made of one-piece wherein the finish provided on the shower stall is tileable. A further object of the present invention is to provide a one-piece tileable shower unit wherein the corners are approximately square so that tile can be placed into the corners. A further object of the present invention is to provide a one-piece tileable shower unit which allows for a quick and easy installation. A further object of the present invention is to provide a one-piece tileable shower unit wherein there will be no joints or seams that can leak. A further object of the present invention is to provide a one-piece tileable shower unit that eliminates or minimizes human error in the installation process. A further object of the present invention is to provide a one-piece tileable shower unit which can be easily used by a professional or novice worker. A further object of the present invention is to provide a one-piece tileable shower unit that can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
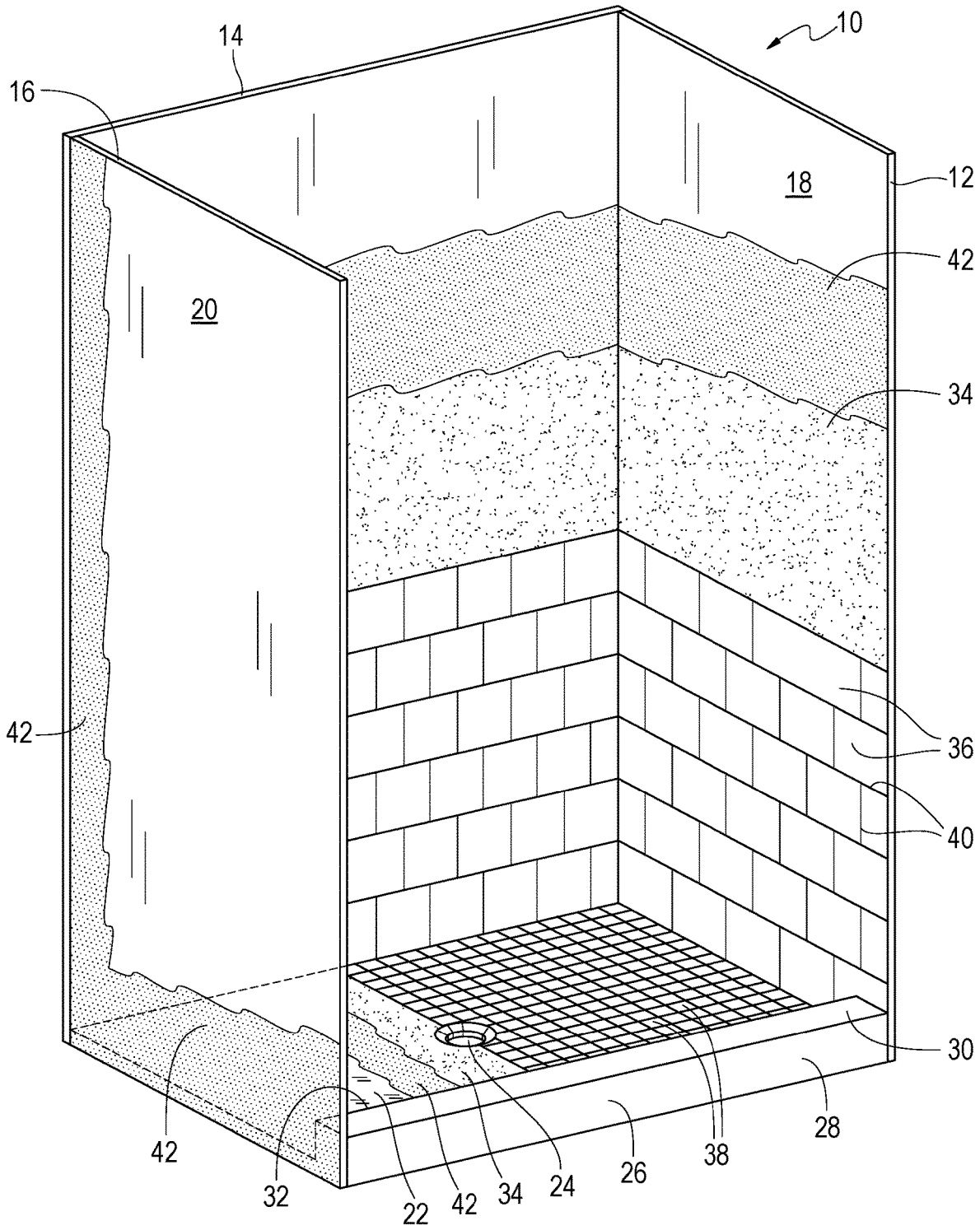
FIG. 1 is a perspective view of the present invention with certain parts being cut-away for ease of illustration.

With regard to reference numerals used, the following numbering is used throughout the drawings.

10 present invention
12 right wall
14 rear wall
16 left wall
18 inner surface
20 outer surface
22 floor
24 drain
26 curb
28 front of curb
30 top of curb
32 inner surface of curb
34 thinset
36 wall tile
38 floor tile
40 grout
42 waterproof coating
44 foam
46 fiberglass
48 inner surface of fiberglass
50 outer surface of fiberglass
52 blocking
54 block

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 4 illustrate the present invention wherein a one-piece tileable shower unit is disclosed and which is generally indicated by reference number 10.

Turning to FIG. 1, therein is shown a perspective view of the present invention 10 having a right wall 12, a rear wall 14, and left wall 16, wherein each wall has an inner surface 18 and an outer surface 20 along with a floor 22 having a drain 24 being generally centrally disposed therein but the drain may be located elsewhere on the floor. Also shown is a curb 26 having a front surface 28, a top surface 30, and an inner surface 32. Shown is a layer of thinset 34 disposed over a waterproof coating 42 on the inner surface 18 of walls 12 and 14 including a plurality of individual pieces of tile 36 disposed over the thinset 34 on the inner surfaces of the walls of the shower unit of the present invention 10. Also shown on the floor 22 are a plurality of individual tile members 38. All of the tile members 36, 38 are joined together in the conventional manner by individual seams of cement or grout 40 being applied around the outer edges of each of the tile members. The rear outer corners and lower outer portions including the bottom of the shower unit of the present invention 10 are covered with a waterproof coating 42 in order to provide additional strength and structural support wherein the waterproof coating 42 is about 4"-6" wide with respect to the rear corners and about 6"-8" wide with respect to the lower portion of the outer wall and bottom of the unit and the coating 42 is about 40-60 mils thick in both areas, about 40-60 mils thick on the floor 22, and, about 15-20 mils thick on the inner surfaces of the walls 12, 14, 16. FIG. 1 features are applicable to both the foam embodiment shown in FIG. 2A and the fiberglass embodiment shown in FIGS. 3A and 4, however, the fiberglass embodiment may or may not have coating 42.

Figure 2B:
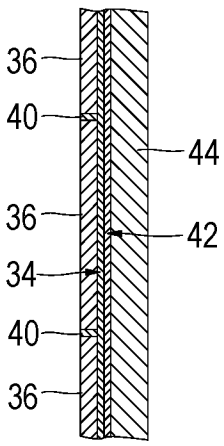
FIGS. 2B and 3B are cross sectional views taken from FIGS. 2A and 3A, respectively, as indicated.
Figure 2A:
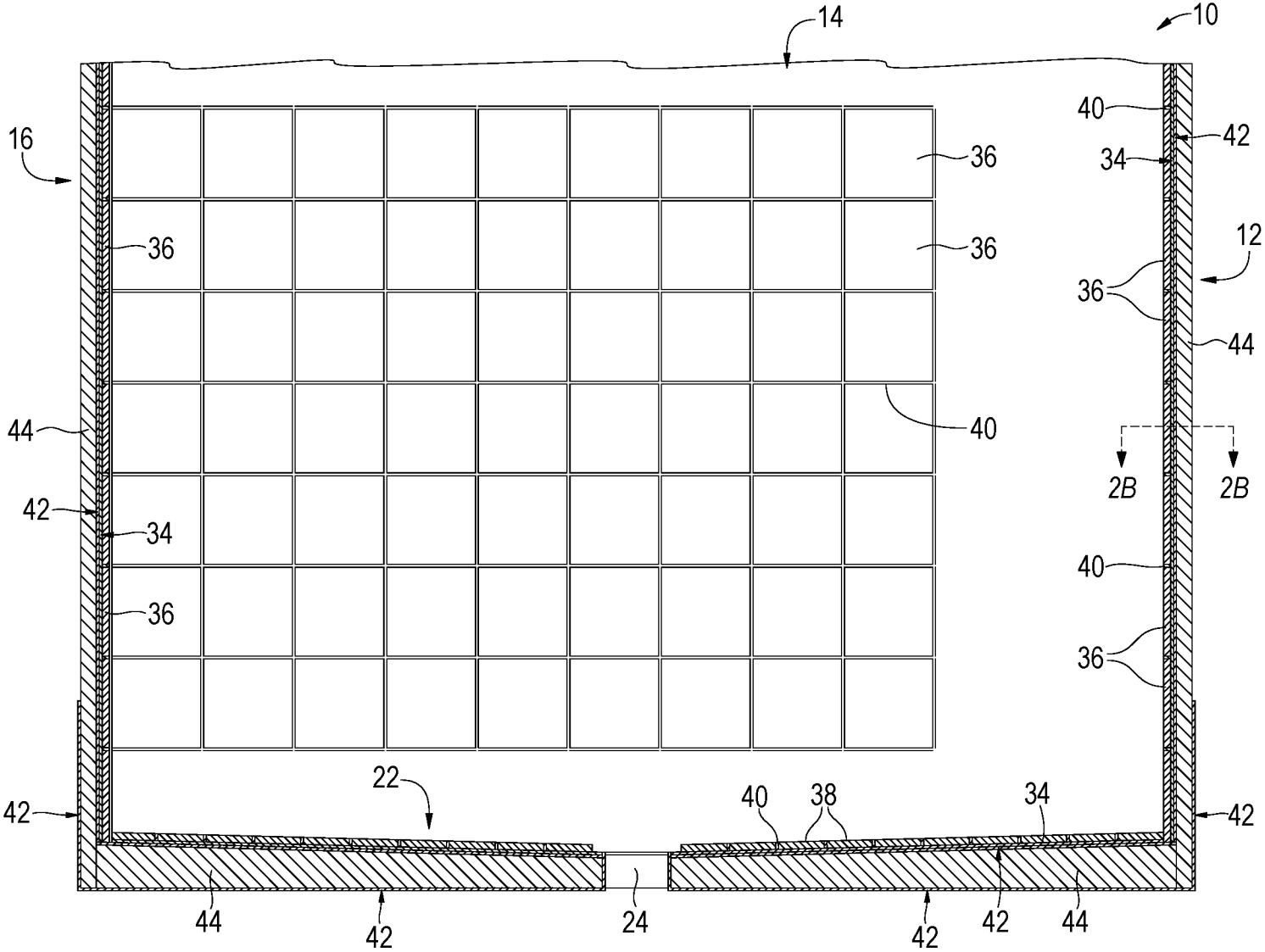
FIGS. 2A and 3A are cross sectional views of the present invention.

Turning to FIGS. 2A and 2B, therein is shown the present invention 10 showing an embodiment including foam 44 with waterproof coating 42 thereon forming the walls and floor for placement thereon of the thinset 34 with the inner tile members 36 being joined together by grout 40 and showing the foam 44 with waterproof coating 42 forming the floor for supporting the thinset and tile layers and additionally showing the drain 24 approximately centered in the floor 22. Also, the floor 22 has an appropriate slope which is generally expected to be approximately ¼" slope per foot from the walls to the drain 24 of the floor in order to provide adequate water drainage for the shower unit of the present invention 10.

Figure 3B:
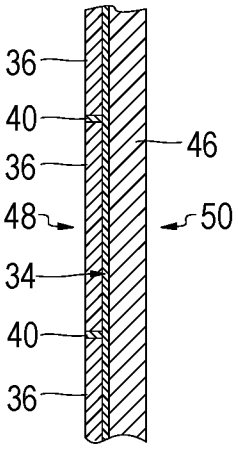
Figure 3A:
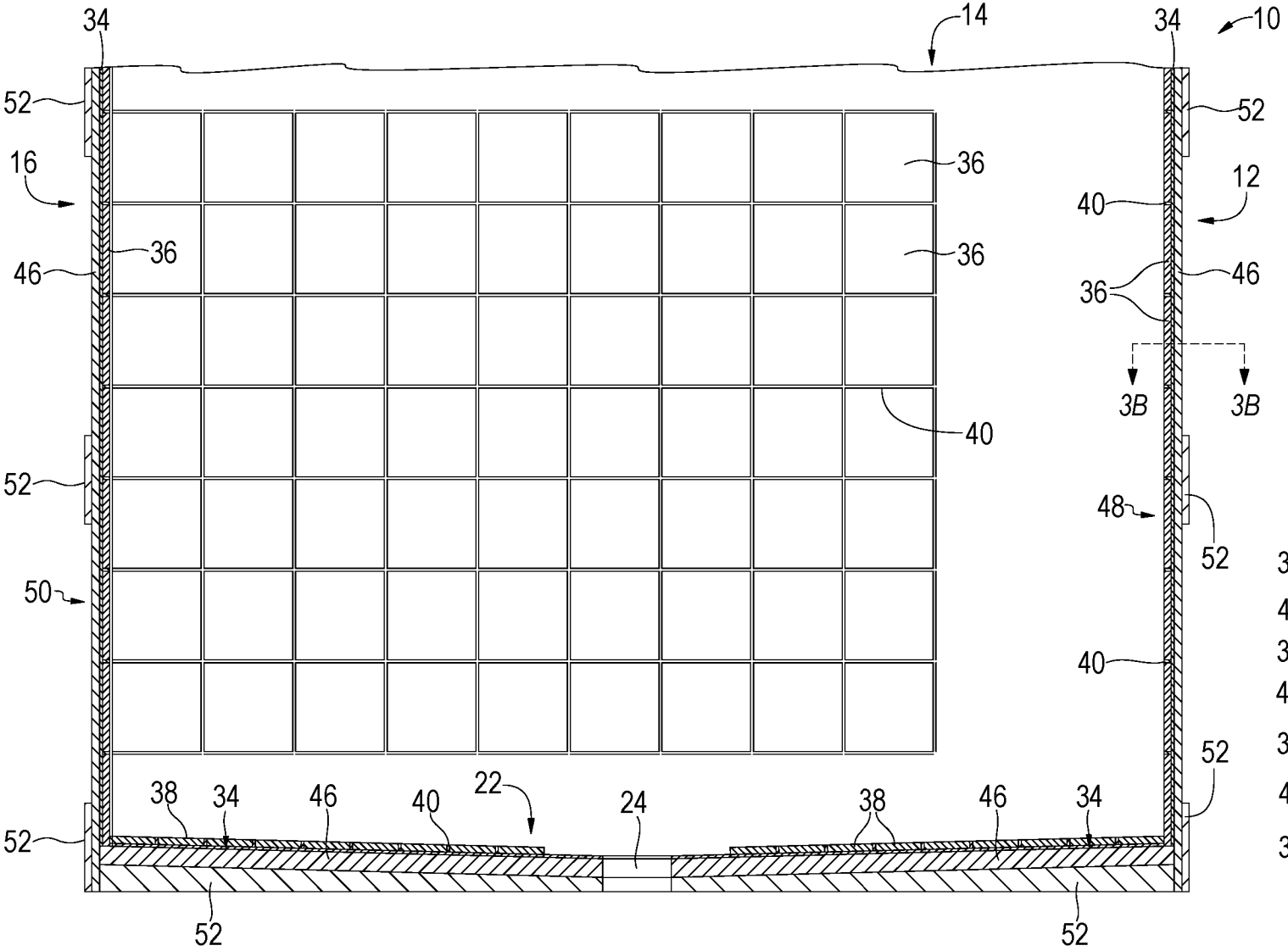

Turning to FIGS. 3A and 3B, therein is shown the present invention 10 showing an alternative embodiment wherein the walls and floor of the present invention 10 are made of fiberglass 46 being approximately 0.25" thick and having inner surface 48 and outer surface 50 and being supported on their outer surfaces by strips of blocking 52 which are stuck to the fiberglass layers 46 while the fiberglass is still wet. Blocking 52 is also shown underneath the main floor 22 of the present invention 10 wherein the tile on the wall 36 is attached to the interior 48 of the fiberglass 46 layers using thinset 34 and wherein the floor tiles 38 are also attached to the fiberglass layers on the floor using thinset 34.

Figure 4:
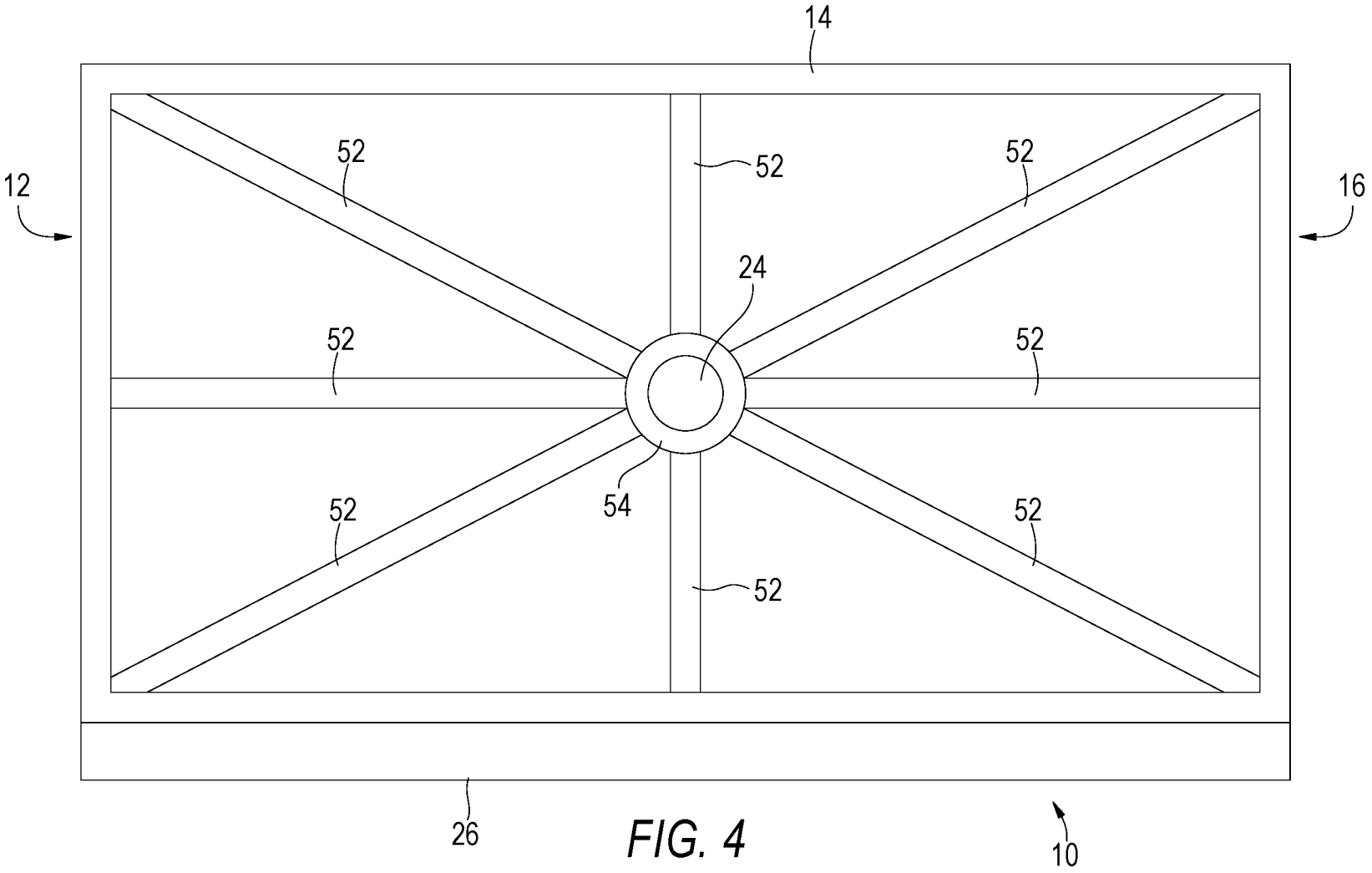
FIG. 4 is a bottom view of the present invention.

Turning to FIG. 4, therein is shown the present invention 10 showing a bottom view of the present invention 10 made of fiberglass 46 showing the floor 22, curb 26 and walls 12, 14, 16, and drain 24 surrounded by a block 54 with a plurality of arm-like members of blocking 52 radiating from the central block 54 toward the walls or outer extremities or perimeter of the present invention 10. The arms 52 are expected to be in the range of 2" to 6" wide, however, they may be of different widths.

The foam unit embodiment of the present invention 10 uses foam 44 with waterproof coating 42 which varies in size according to the particular shower unit which foam is usually about 0.75" thick at the drain 24 having a floor 22 slope of approximately 0.25" per foot per length/width of the floor. The floor 22 is usually approximately 0.75" thick at the drain 24 and gets thicker as the floor extends towards the outer perimeter or walls of the shower unit. The tile is usually approximately 5/16" thick but this varies. The thinset is usually approximately ⅛" thick. The wall is approximately 0.5" thick and the curb is approximately 4"×4".

Concerning the fiberglass embodiment unit of the present invention 10, the floor is approximate 0.25" thick; the blocking 52 varies in thickness under the floor similar to the foam floor and uses the same slope as the foam embodiments herein. The wall is approximately 0.25" thick. The blocking 52 is approximately 0.25" and these are similar to and may be referred to as furring strips.

By way of additional explanation and by making reference to FIG. 1-4, the present invention 10 discloses a one-piece tillable shower unit much like any finished fiberglass shower unit being used today, but made without a decorative finish, and instead having a tillable surface. The corners and edges have to be square for the most part instead of rounded in order for tile to fit. The walls 12, 14, 16 have to be the correct thickness to line up with sheetrock or wallboard after installation for a seamless fit and look on the walls of the room in which the present invention 10 is installed. The floor 22 would have the correct approximate 2% slope from the farthest point from the drain to insure proper water drainage. The outside edge around the floor 22 would remain level so the wall tile would start off level at the floor. The units could be made in standard sizes or custom sizes with custom shapes and drain locations and walls could be on one, two, or three sides. The units would be installed as one-piece seamless ready to tile unit with no additional waterproofing needed on floors or walls and no seams to possibly leak. These units could be made of extruded high density foam 44 comprising a floor 22, curb 26 and walls 12, 14, 16 then coated with a waterproof coating 42 to make it a one-piece unit. Other embodiments could include a one-piece fiberglass unit or injection molded unit. Most of these units would be installed during the plumbing stack-out phase of construction just like any other finished shower or shower tub combo, then the sheetrock would be hung butting to it and finished. Tile 36, 38 could be set at any time after that with no other work needed other than just laying the tile. There would be a one to four day time savings over traditional methods of putting in a pre-slope floor, a rubber liner, backer-board on the walls, pouring the mud bed, letting it dry, taping and floating corners and wall seams and then waterproofing the walls with a sheet or liquid coating.

To make the unit using foam 44, one would start with a foam piece big enough to machine the floor 22. Once the floor 22 is sized, sloped and the drain hole put in place, one would attach the curb 26 (or not for curb-less) with glue. Then the walls 12, 14, 16 would be attached with glue which walls would be approximately 60" to 96" tall or high (height). After assembly is complete, the assembled unit is coated with a waterproofing and strengthening coating 42 to make it a one-piece unit for easy quick lightweight installation.

To make the unit of fiberglass 46, there would be a mold made and then a release agent applied. The mold would then be coated with a three part fiberglass (glass, hardener and fiber) using a chopper gun; then rolling it out to make it flat. In the coating process wood, foam or composite blocking, i.e., braces, would be placed in the bottom of the unit so it would sit flat on the subfloor below so there will be no flexing to prevent cracking of tile or grout. The walls would have ribs or blocking to strengthen and give the wall the correct thickness without the fiberglass 46 having to be as thick as the wall board it is matching. After curing, it would be pulled from the mold, sprayed with a coating 42 for waterproofing or sheer bond strength if needed on the to be tiled surface. The resin unit would most likely be injection molded as a one-piece unit which would be fast and cheap, except for the cost of the mold. Another method would be for the base to be made as one-piece, each wall as one-piece, then fused together in the factory to make it one-piece before it is shipped.

The present invention 10 would prevent installation error that could lead to leakage or water puddling due to dips in the floors. Most units would be installed by the plumber not the tile installer, when the tile installers get to the job they are ready to install tile. These units would have a guarantee against leakage that could be much longer than most methods used to build a tile shower.

The present invention 10 would provide a unique product that would eliminate three to four extra steps in the process of building a tile shower along with the guarantee of no leaks or puddling. With these units made according to the teachings of the present invention 10, even a novice could easily build a leak proof shower with the correct floor slope every time.

Left and right side designations regarding the present invention 10 are interpreted from the view of one standing in front of the present invention as shown in FIG. 1 preparing to enter the shower unit while looking at the rear wall 14.

I claim:

1. A method of making and installing a one-piece tileable shower unit in a room under construction, comprising the steps of:

a) assembling in a remote location said one-piece shower unit from a rigid material having left and right side walls, a rear wall, a floor, and a curb on said floor spanning a front opening into said shower unit, all corners and edges of said walls and floor being square instead of rounded in order for tiles to fit;

b) coating all inner surfaces of said walls and floor with a waterproof material;

c) transporting said shower unit to said room under construction;

d) installing said shower unit in said room with said walls lined up with existing sheetrock or wallboard for a seamless fit and look on the walls of said room, said walls of said shower unit having a thickness to match up with said existing sheetrock or wallboard in said room;

e) layering thinset on all inner surfaces of said waterproof material to be tiled, and placing tiles on said inner surfaces with grout between said tiles;

f) in which said walls are constructed of a rigid material selected from the group consisting of foam and fiberglass; and g) in which rear outer corners and lower outer portions of the walls including a bottom of the shower unit are covered with a waterproof coating to provide additional strength and structural support.

2. The method of claim 1, in which an upper surface of the floor has a slope of approximately 2% from a farthest point from the drain to insure proper water drainage.

3. The method of claim 2, in which the walls are constructed of foam and the waterproof coating is about 4" to about 6" wide with respect to the rear outer corners and bottom of the shower unit and about 40-60 mils thick, and the waterproofing is about 15-20 mils thick on the inner surfaces of the walls.

4. The method of claim 2, in which the walls are constructed of fiberglass and being approximately 0.25" thick and being supported on outer surfaces thereof by strips of blocking which are stuck to the fiberglass while the fiberglass is wet, and the blocking being also mounted underneath the floor.

5. The method of claim 4, in which an underside of the floor is provided with blocking comprising a portion of blocking surrounding the drain with arm-like members radiating therefrom to bottoms of the rear and side walls, and the curb.

6. The method of claim 1, in which the walls are about 60-96 inches in height.

* * * * *